US008866077B2

(12) United States Patent
Okumura et al.

(10) Patent No.: US 8,866,077 B2
(45) Date of Patent: Oct. 21, 2014

(54) MASS SPECTROMETER

(75) Inventors: Daisuke Okumura, Shimamoto-cho (JP); Manabu Ueda, Kyotanabe (JP)

(73) Assignee: Shimadzu Corporation, Kyoto (JP)

( * ) Notice: Subject to any disclaimer, the term of this patent is extended or adjusted under 35 U.S.C. 154(b) by 0 days.

(21) Appl. No.: 14/352,912

(22) PCT Filed: Oct. 20, 2011

(86) PCT No.: PCT/JP2011/074195

§ 371 (c)(1), (2), (4) Date: Apr. 18, 2014

(87) PCT Pub. No.: WO2013/057822

PCT Pub. Date: Apr. 25, 2013

(65) Prior Publication Data

US 2014/0252217 A1 Sep. 11, 2014

(51) Int. Cl.

| | |
|---|---|
| ***H01J 49/26*** | (2006.01) |
| ***H01J 49/06*** | (2006.01) |
| ***H01J 49/24*** | (2006.01) |

(52) U.S. Cl.

CPC ..... *H01J 49/24* (2013.01); *H01J 49/063* (2013.01)

USPC ..... 250/293; 250/282; 250/396 R

(58) Field of Classification Search

USPC ..... 250/281, 282, 288, 293, 396 R

See application file for complete search history.

(56) References Cited

U.S. PATENT DOCUMENTS

| | | | | |
|---|---|---|---|---|
| 5,481,107 | A * | 1/1996 | Takada et al. | 250/281 |
| 5,663,560 | A * | 9/1997 | Sakairi et al. | 250/281 |
| 5,847,386 | A * | 12/1998 | Thomson et al. | 250/288 |
| 6,005,245 | A * | 12/1999 | Sakairi et al. | 250/281 |
| 6,744,043 | B2 * | 6/2004 | Loboda | 250/287 |
| 6,753,523 | B1 * | 6/2004 | Whitehouse et al. | 250/292 |
| 6,872,938 | B2 * | 3/2005 | Makarov et al. | 250/281 |
| 7,189,967 | B1 | 3/2007 | Whitehouse et al. | |
| RE40,632 | E | 2/2009 | Tang et al. | |
| 2002/0162959 | A1 * | 11/2002 | Itoi | 250/292 |
| 2004/0061038 | A1 * | 4/2004 | Solich | 248/444 |
| 2006/0033153 | A1 * | 2/2006 | Onishi et al. | 257/328 |
| 2007/0057180 | A1 * | 3/2007 | Hansen et al. | 250/292 |
| 2007/0164213 | A1 * | 7/2007 | Javahery et al. | 250/292 |
| 2009/0218484 | A1 * | 9/2009 | Javahery et al. | 250/282 |

FOREIGN PATENT DOCUMENTS

| | | | |
|---|---|---|---|
| CA | 2 636 821 | A1 | 7/2007 |
| DE | 11 2007 000 146 | T5 | 12/2008 |
| GB | 2455831 | B | 6/2011 |
| JP | 7-85834 | A | 3/1995 |
| JP | 2000-149865 | A | 5/2000 |
| JP | 2002-329474 | A | 11/2002 |
| JP | 2009-523300 | A | 6/2009 |
| WO | 2007/079588 | A1 | 7/2007 |

* cited by examiner

*Primary Examiner* — Bernard E Souw

(74) *Attorney, Agent, or Firm* — Sughrue Mion, PLLC

(57) ABSTRACT

A mass spectrometer having a multi-stage differential pumping system with an ion lens provided in a partition wall separating a second intermediate vacuum chamber and a third intermediate vacuum chamber, the incircle radii of ion guides and the size of the opening of the ion lens are determined so that the circumferential edge of the opening is located outside the circumferential surface of a virtual tubular body straightly connecting the incircle at the rear edge of the second ion guide in the front stage and the incircle at the front edge of the third ion guide in the rear stage. Although the ion lens is located in between, the radio-frequency electric field created by the second ion guide can be effectively connected to the radio-frequency electric field created by the third ion guide through the opening of the ion lens.

12 Claims, 5 Drawing Sheets

INCIRCLE RADIUS : 2.8mm

INCIRCLE RADIUS : 2.0mm

INCIRCLE RADIUS : 1.5mm

MASS SPECTROMETER

CROSS REFERENCE TO RELATED APPLICATIONS

This application is a National Stage of International Application No. PCT/JP2011/074195, filed on Oct. 20, 2011, the contents of all of which are incorporated herein by reference in their entirety.

TECHNICAL FIELD

The present invention relates to a mass spectrometer, and more specifically, to an ion transport optical system for transporting ions to the subsequent stage in a mass spectrometer.

BACKGROUND ART

In a mass spectrometer, an ion optical element called an "ion guide" is used in order to focus ions coming from the previous stage and send them into a mass analyzer, such as a quadrupole mass filter. A typical structure of the ion guide is a multi-pole structure having four, six or eight columnar (or tubular) rod electrodes aligned parallel to each other around an ion-beam axis. Normally, in these types of multi-pole ion guides, two radio-frequency voltages having the same amplitude with opposite phases are applied to the rod electrodes in such a manner that one radio-frequency voltage is applied to a pair of rod electrodes facing each other across the ion-beam axis while the other radio-frequency voltage is applied to another pair of rod electrodes which are adjacent to the former pair in the circumferential direction. By applying such radio-frequency voltages, a multi-pole radio-frequency electric field is created within a substantially columnar space surrounded by the rod electrodes. Ions are transported through this space while being oscillated due to the radio-frequency electric field.

In an ion guide described in Patent Literature 1, a set of virtual rod electrodes, each of which consists of a plurality of plate electrodes arranged along an ion-beam axis, is used in place of the normal rod electrodes. With the virtual-rod system, a DC electric field having a potential gradient along the ion-beam axis can be created so as to accelerate or decelerate ions, while making use of the excellent ion-focusing capability which is characteristic of multi-pole ion guides. It should be noted that the "multi-pole ion guide" in the present description includes such a "virtual" multi-pole ion guide using virtual rod electrodes.

In a liquid chromatograph mass spectrometer (LC/MS) or other mass spectrometers using an electrospray ion source or similar atmospheric pressure ion source, the configuration of a multi-stage differential pumping system is normally adopted so as to maintain a high degree of vacuum inside an analyzing chamber in which a mass analyzer and an ion detector are provided.

For example, in a mass spectrometer described in Patent Literature 2, three intermediate vacuum chambers are provided in tandem between an ionization chamber maintained at approximately atmospheric pressure and an analyzing chamber maintained in a high vacuum state, with the degree of vacuum being increased at each chamber from the ionization chamber to the analyzing chamber. To efficiently transportions in this multi-stage differential pumping system, a multi-pole ion guide is provided in each of the second and third intermediate vacuum chambers. Furthermore, an ion lens having an opening with a small diameter for allowing focused ions to pass through is provided in a partition which separates the second and third intermediate vacuum chambers.

The ion lens has the effect of focusing ions by a lens effect due to the DC electric field. However, a loss of ions occurs in a region near the boundary between the radio-frequency electric field created by the front-stage ion guide and the DC electric field created by the ion lens, as well as in a region near the boundary between the DC electric field created by the ion lens and the radio-frequency electric field created by the rear-stage ion guide, causing a decrease in the transmission efficiency of the ions. A probable reason for the loss of the ions is a disturbance of the electric field in the region near the boundary between the DC electric field and the radio-frequency electric field.

A mass spectrometer described in Patent Literature 3 has a multi-stage differential pumping system with an ion guide continuously extending over a length encompassing a plurality of intermediate vacuum chambers neighboring each other. In this system, since the radio-frequency electric field continuously extends through the plurality of intermediate vacuum chambers, the loss of the ions as observed in the system described in Patent Literature 2 does not occur, and a higher level of ion transmission efficiency can be achieved. However, an ion guide which extends over a length encompassing a plurality of intermediate vacuum chambers, i.e. which is provided in such a manner as to penetrate the partition walls separating the neighboring intermediate vacuum chambers, cannot be easily removed for the task of cleaning or replacement, and therefore, lowers the maintenance efficiency.

CITATION LIST

Patent Literature

Patent Literature 1: JP 2000-149865 A
Patent Literature 2: US RE40632 E
Patent Literature 3: U.S. Pat. No. 7,189,967 B

SUMMARY OF INVENTION

Technical Problem

The present invention has been developed to solve the previously described problem. Its primary objective is to improve the detection sensitivity of a mass spectrometer including a multi-stage differential pumping system by increasing the ion transmission efficiency between the neighboring vacuum chambers, while ensuring a high level of maintenance efficiency.

Solution to Problem

The present invention aimed at solving the previously described problem is a mass spectrometer having an ion transport optical system in which an ion lens or an aperture plate having an opening for allowing ions to pass through is provided between a front-stage multi-pole ion guide and a rear-stage multi-pole ion guide, wherein:

the relationship between the size of the opening of the ion lens or the aperture plate and the radius of the incircle of each of the ion guides is determined so that the circumferential edge of the opening of the ion lens or the aperture plate is located on or outside a circumferential surface of a virtual tubular body straightly connecting the incircle at the rear edge of the front-stage ion guide and the incircle at the front edge of the rear-stage ion guide.

In the mass spectrometer according to the present invention, the ion lens is a device having the function of focusing ions by means of a DC electric field, while the aperture plate is a member which has an opening for simply allowing ions to pass through without focusing the ions. The ion guide typically consists of quadrupole or octapole rod electrodes, in which a multi-pole electric field is created by applying two radio-frequency voltages having the same amplitude with opposite phases to the rod electrodes in such a manner that one radio-frequency voltage is applied to a pair of rod electrodes facing each other across the ion-beam axis while the other radio-frequency voltage is applied to another pair of rod electrodes which are adjacent to the former pair in the circumferential direction around the ion-beam axis.

In the mass spectrometer according to the present invention, since the circumferential edge of the opening of the ion lens or the aperture plate does not protrude inwards from the circumferential surface of the virtual tubular body straightly connecting the incircle (inscribed circle) at the rear edge of the front-stage ion guide and the incircle at the front edge of the rear-stage ion guide, the radio-frequency electric fields respectively created by the front-stage and rear-stage ion guides can easily enter the opening of the ion lens or the aperture plate and form an effectively continuous radio-frequency electric field. Therefore, the ions which travel through the front-stage ion guide while oscillating in a confined form due to effect of the radio-frequency electric field created by the front-stage ion guide can smoothly move into the radio-frequency electric field created by the rear-stage ion guide. As a result, the loss of the ions passing through the ion lens or the aperture plate is suppressed and the ion transmission efficiency is improved.

In one mode of the mass spectrometer according to the present invention, the front-stage and rear-stage ion guides have their respective straight ion-beam axes lying on the same straight line, each of the ion guides being composed of a plurality of rod electrodes aligned parallel to the ion-beam axis, and the two ion guides having the same incircle radius. This mode of the mass spectrometer is advantageous in terms of the production cost since the same configuration and structure can be applied to both the front-stage and rear-stage ion guides.

In this case, the ion lens or the aperture plate may be designed so that the ion-beam axis of the ion lens or the aperture plate lies on the same straight line as the ion-beam axes of the front-stage and rear-stage ion guides, and the radius of the circular opening of the ion lens or the aperture plate is equal to the incircle radius of the two ion guides. This design minimizes the size of the opening of the ion lens or the aperture plate within a range where the ion transmission efficiency does not decrease, thereby allowing minimum amount of gas (e.g. atmospheric gas) to pass through the opening, so that the degree of vacuum in the chamber containing the rear-stage ion guide can be easily maintained.

In another mode of the mass spectrometer according to the present invention, the front-stage and rear-stage ion guides have their respective straight ion-beam axes lying on the same straight line, each of the ion guides being composed of a plurality of rod electrodes aligned parallel to the ion-beam axis, and the incircle radius of one of the ion guides being smaller than the incircle radius of the other ion guide. For example, if the incircle radius of the rear-stage ion guide is smaller than that of the front-stage ion guide, the ions will be more concentrated around the ion-beam axis before being sent to the subsequent stage.

In still another mode of the mass spectrometer according to the present invention, the front-stage and rear-stage ion guides have their respective straight ion-beam axes lying on the same straight line, each of the ion guides being composed of a plurality of rod electrodes arranged along the ion-beam axis, and the rod electrodes of at least one of the ion guides being arranged so that the incircle radius increases with an increase in the distance from the ion lens or the aperture plate. For example, if the rod electrodes of the front-stage ion guide are arranged so that the incircle radius increases with an increase in the distance from the ion lens or the aperture plate, the ions which are initially spread in the front-stage ion guide will be gradually gathered around the ion-beam axis, to be focused into a small diameter before being sent into the rear-stage ion guide.

In the case where the ion-beam axis of the ion lens or the aperture plate lies on the same straight line as the ion-beam axes of the two ion guides and the incircle radius at the rear edge of the front-stage ion guide is different from the incircle radius at the front edge of the rear-stage ion guide, the radius of the circular opening of the ion lens or the aperture plate may preferably be larger than the radius of either the incircle at the rear edge of the front-stage ion guide or the incircle at the front edge of the rear-stage ion guide, whichever is smaller, as well as smaller than the radius of the other incircle. This design decreases the size of the opening of the ion lens or the aperture plate within a range where the ion transmission efficiency does not decrease, thereby allowing only a small amount of gas to pass through the opening.

In the mass spectrometer according to the present invention, the front-stage and rear-stage ion guides do not always need to have their respective ion-beam axes lying on the same straight line, but may be constructed as a so-called "off-axis" ion optical system in which the two ion-beam axes are displaced from each other. Thus, in still another mode of the mass spectrometer according to the present invention, each of the front-stage and rear-stage ion guides is composed of a plurality of rod electrodes arranged along a straight ion-beam axis, and the ion-beam axes of the two ion guides are parallel to each other and do not lie on the same straight line.

In the mass spectrometer according to the present invention, the distance between the rear edge of the front-stage ion guide and the ion lens or the aperture plate, as well as the distance between the front edge of the rear-stage ion guide and the ion lens or the aperture plate, should preferably be determined so as to allow the radio-frequency electric field created by each of the ion guides to penetrate into the opening of the ion lens or the aperture plate. Specifically, each of those distances should preferably be equal to or smaller than both the incircle radius of the ion guide and the radius of the opening. This design improves the continuity between the radio-frequency electric field created by the front-stage ion guide and that created by the rear-stage ion guide, and thereby effectively suppresses the loss of the ions.

The ion lens or the aperture plate may double as, or be provided in, a partition wall separating two spaces maintained at different degrees of vacuum in a multi-stage differential pumping system or similar configuration, but is not limited to this form. The ion lens or the aperture plate does not need to be a single element but may consist of a plurality of elements arrayed in the passing direction of the ions.

The rear-stage ion guide is not limited to an ion guide in the narrow sense designed for merely transporting ions to the subsequent stage. It may be an ion guide which functions as a quadrupole mass filter for separating ions according to their mass-to-charge ratios or as a pre-filter provided before a main quadrupole mass filter.

Advantageous Effects of the Invention

In the mass spectrometer according to the present invention, the ion-confining effect of the two radio-frequency electric fields respectively created by the front-stage and rear-stage ion guides seamlessly continues at the opening of the ion lens or the aperture plate and thereby improves the ion transmission efficiency. As a result, a larger amount of ions will be subjected to mass spectrometry and the detection sensitivity will be improved. Since the ion guides are physically independent of each other with the ion lens or the aperture plate in between, the task of maintenance for the ion guides, such as cleaning or replacement, can be efficiently performed.

DESCRIPTION OF EMBODIMENTS

A mass spectrometer as one embodiment of the present invention is hereinafter described with reference to the attached drawings.

First Embodiment

Figure 1:
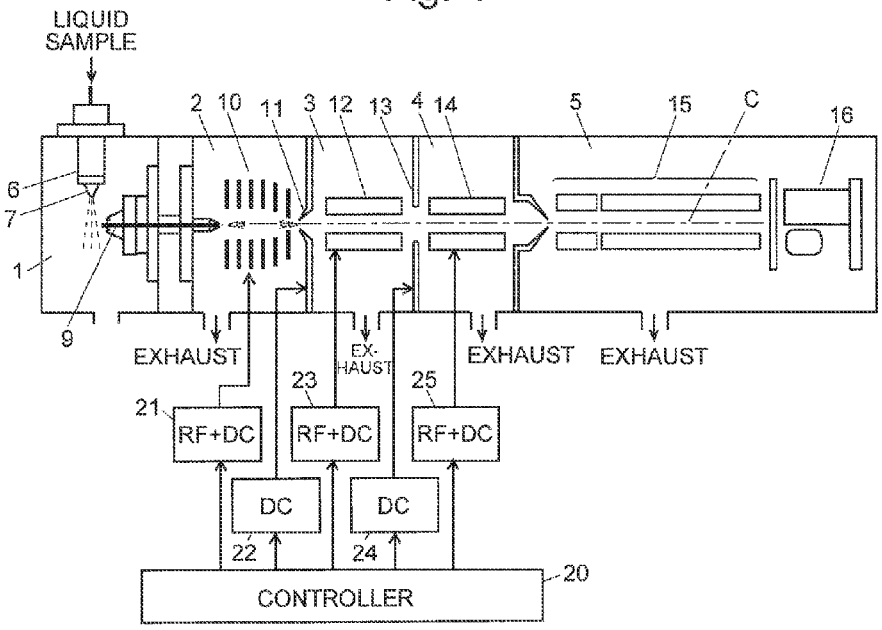
FIG. 1 is a schematic configuration diagram of a mass spectrometer according to the first embodiment of the present invention.
Figure 2:
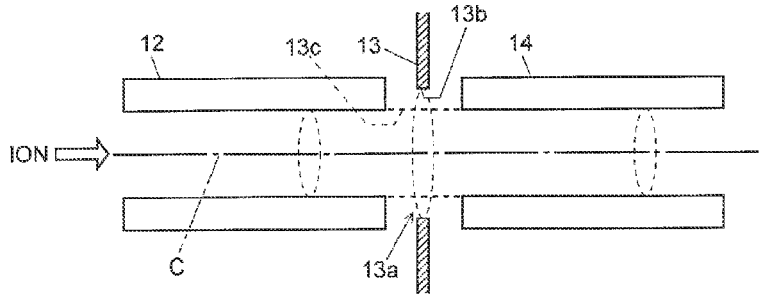
FIG. 2 is a configuration diagram of an ion transport optical system in the first embodiment.

FIG. 1 is a schematic configuration diagram of a mass spectrometer according to the first embodiment, and FIG. 2 is a schematic configuration diagram of an ion transport optical system including ion guides and an ion lens characteristic of the mass spectrometer of the first embodiment.

The atmospheric pressure ionization mass spectrometer of the present embodiment includes an ionization chamber 1 maintained at approximately atmospheric pressure, an analyzing chamber 5 maintained in a high vacuum state by evacuation using a turbo-molecular pump or similar vacuum pump (not shown), as well as a first intermediate vacuum chamber 2, a second intermediate vacuum chamber 3 and a third intermediate vacuum chamber 4 each of which is maintained at an intermediate gas pressure between the gas pressure in the ionization chamber 1 and the gas pressure in the analyzing chamber 5 by evacuation using a vacuum pump. That is to say, the present atmospheric pressure ionization mass spectrometer has the configuration of a multi-stage differential pumping system in which the gas pressure decreases (or the degree of vacuum increases) at each chamber from the ionization chamber 1 toward the analyzing chamber 5.

The ionization chamber 1 contains an ionization probe 6 connected to the outlet of a column of a liquid chromatograph (not shown). The analyzing chamber 5 contains a quadrupole mass filter 15 and an ion detector 16. The first through third intermediate vacuum chambers 2, 3 and 4 respectively contain first through third ion guides 10, 12 and 14 for transporting ions to the subsequent stage. The ionization chamber 1 and the first intermediate vacuum chamber 2 communicate with each other through a thin desolvation pipe 9. The first and second intermediate vacuum chambers 2 and 3 communicate with each other through a micro-sized aperture formed at the apex of a skimmer 11. The second and third intermediate vacuum chambers 3 and 4 communicate with each other through a circular opening 13*a* of an ion lens 13 provided in a partition wall.

A high voltage of a few to several kV is applied to the tip of the nozzle 7 of the ionization probe 6 from a DC high voltage source (not shown). When a liquid sample introduced into the ionization probe 6 reaches the tip of the nozzle 7, the liquid sample is given biased electric charges and sprayed into the ionization chamber 1. The micro droplets in the spray flow come in contact with atmospheric gas, to be divided into smaller droplets. As the mobile phase and the solvent vaporize, the droplets become even smaller in size. During this process, the sample components (molecules or atoms) in the droplets are released from the droplets together with the electric charges and turn into gaseous ions. The generated ions are drawn into the desolvation pipe 9 due to the pressure difference between the ionization chamber 1 and the first intermediate vacuum chamber 2, to be sent into this chamber 2.

The ion transport optical system including the first ion guide 10 through the third ion guide 14 has the function of transporting ions to the quadrupole mass filter 15 in the analyzing chamber 5 with the lowest possible loss of the ions. In FIG. 1, the control system blocks for applying voltages to the ion optical devices constituting this ion transport optical system are also shown. The first AC-DC voltage source 21, the second AC-DC voltage source 23 and the third AC-DC voltage source 25 respectively apply voltages to the first, second and third ion guides 10, 12 and 14 under the command of the controller 20, with each voltage being composed of a DC voltage and an AC voltage (radio-frequency voltage) superposed on each other. Similarly, under the command of the controller 20, the first DC voltage source 22 and the second DC voltage source 24 respectively apply DC voltages to the skimmer 11 and the ion lens 13. The DC voltages applied to the first, second and third ion guides 10, 12 and 14 are bias voltages which determine the DC potential along the ion-beam axis C.

The ions are sent into the quadrupole mass filter 15 by the ion transport optical system. A voltage generated by superposing a DC voltage and a radio-frequency voltage corresponding to the mass-to-charge ratio of an ion to be analyzed is applied from a voltage source (not shown) to each of the rod electrodes constituting the quadrupole mass filter 15. Only the ions having a mass-to-charge ratio corresponding to the applied voltage are allowed to pass through the longitudinal space in the quadrupole mass filter 15. The ion detector 16 produces detection signals corresponding to the amount of ions which have reached the detector. Based on the detection signals, a data processor (not shown) creates, for example, a mass spectrum.

As already stated, the ion transport optical system has the important function of efficiently transporting ions generated in the ionization chamber 1 to the quadrupole mass filter 15. For this purpose, the ion transport optical system of the mass spectrometer according to the present embodiment has a characteristic configuration as shown in FIG. 2. The following descriptions specifically deal with the configuration and operation of the ion lens 13 as well as those of the second and third ion guides 12 and 13 respectively provided in the second and third intermediate vacuum chambers 3 and 4 separated by the ion lens 13.

Each of the second and third ion guides 12 and 14 has a quadrupole configuration composed of four parallel rod electrodes symmetrically aligned around a straight ion-beam axis. Both ion guides 12 and 14 have their respective ion-beam axes lying on the same straight line labelled "C" in FIGS. 1 and 2. The ion lens 13 located between them also has its ion-beam axis lying on the same straight line. The incircle radii of the second and third ion guides 12 and 14 are equal to each other, while the radius of the circular opening 13*a* of the ion lens 13 is larger than the incircle radius of those ion guides 12 and 14. That is to say, the circumferential edge 13*b* of the opening 13*a* of the ion lens 13 is outside the circumferential surface of a virtual tubular body 13*c* which straightly connects the incircle at the rear edge of the second ion guide 12 and the incircle at the front edge of the second ion guide 14. This means that the nearly cylindrical space surrounded by the rod electrodes of the second ion guide 12 is smoothly connected with the nearly cylindrical space surrounded by the rod electrodes of the third ion guide 14 via the virtual tubular body 13*c*, with no obstacle in between.

The radio-frequency voltage applied from the second AC-DC voltage source 23 to each of the rod electrodes of the second ion guide 12 creates a quadrupole radio-frequency electric field in the space surrounded by those rod electrodes, and ions are confined in this space due to the effect of the electric field. Similarly, the radio-frequency voltage applied from the third AC-DC voltage source 25 to each of the rod electrodes of the third ion guide 14 creates a quadrupole radio-frequency electric field in the space surrounded by those rod electrodes, and ions are confined in this space due to the effect of the electric field. The radio-frequency electric field created by the second ion guide 12 spreads rearward from the incircle at the rear edge of the ion guide 12, while the radio-frequency electric field created by the third ion guide 14 spreads frontward from the incircle at the front edge of the ion guide 14. As already explained, although the two ion guides 12 and 14 are respectively contained in the separate intermediate vacuum chambers 3 and 4, the two radio-frequency electric fields can be effectively connected since there is no obstacle to the radio-frequency electric fields spreading in the space between the two ion guides 12 and 14. Therefore, the ions travelling through the second ion guide 12 in a confined form will not spread when passing through the space between the two ion guides 12 and 14 (i.e. through the opening 13*a* of the ion lens 13) and will be introduced into the third ion guide 14 while maintaining the almost confined form. Thus, only a low loss of ions occurs in the process of transporting the ions from the second ion guide 12 to the third ion guide 14, so that a high level of ion transmission efficiency will be achieved.

In order to ensure a effective continuity of the radio-frequency electric fields in the space between the two ion guides 12 and 14 in the previously described manner, the radio-frequency electric field created by the second ion guide 12 needs to be in phase with the radio-frequency electric field created by the third ion guide 14. Therefore, the two radio-frequency voltages respectively applied to the second ion guide 12 and the third ion guide 14 should have the same frequency and the same phase, or the same frequency with a phase difference within a predetermined allowable range.

The minimal requirement of the radius of the opening 13*a* of the ion lens 13 is that it should be equal to or larger than the incircle radius of the ion guides 12 and 14. However, if the opening 13*a* is too large, a considerable amount of gas flows from the second intermediate vacuum chamber 3, into the third intermediate vacuum chamber 4*a*, making it difficult to ensure an adequate degree of vacuum in the third intermediate vacuum chamber 4 or making it necessary to increase the power of the pump for evacuating the third intermediate vacuum chamber 4. Accordingly, the radius of the opening 13*a* of the ion lens 13 should preferably be equal to or only slightly larger than the incircle radius of the ion guides 12 and 14.

The content and the result of an experiment conducted for demonstrating the effect of the ion transport optical system according to the previously described embodiment is hereinafter described.

The configuration of the ion transport optical system used for the experiment was as shown in FIG. 2; both the incircle radius of the second ion guide 12 in the front stage and that of the third ion guide 14 in the rear stage were set at the same value, R, while the diameter of the opening 13*a* of the ion lens 13 located between them was fixed to 4 mm (radius=2 mm)

(1) Radio-Frequency Voltage Characteristics

Figure 7A:
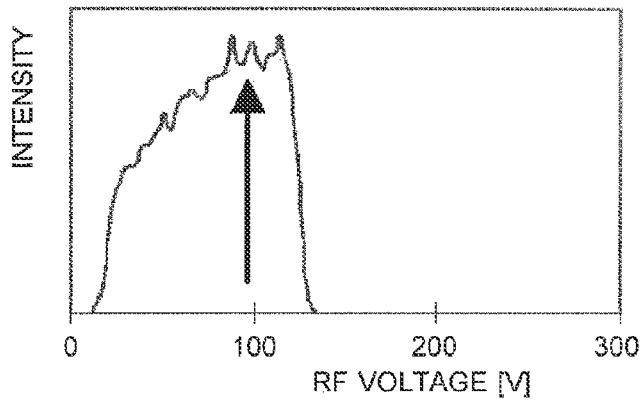
FIGS. 7A-7C show measured results of a relationship between the radio-frequency voltage and the ion intensity in the case of using ion guides having different radii of the incircle.
Figure 7B:
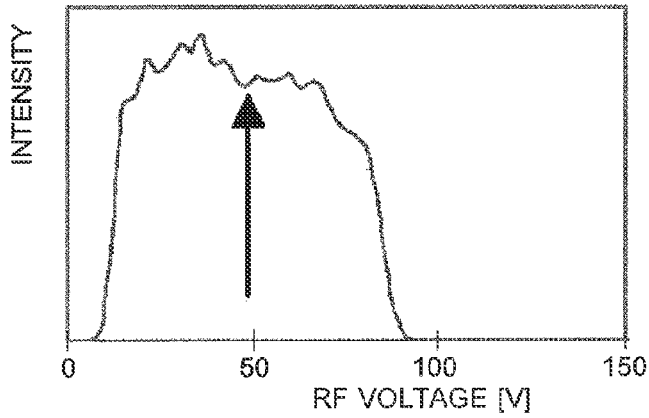
Figure 7C:
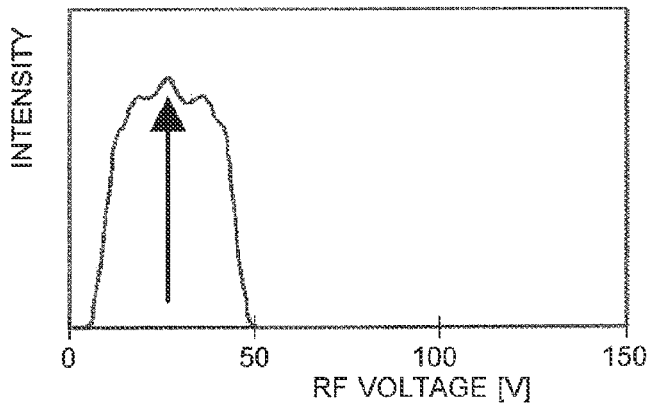

To determine an appropriate radio-frequency operating voltage for each of the three cases where the incircle radii of the second and third ion guides 12 and 14 were set at R=2.8 mm, 2.0 mm and 1.5 mm, an ion intensity for a standard sample was measured while the radio-frequency voltages (RF voltages) applied to the ion guides 12 and 14 were continuously varied. FIGS. 7A-7C show the measured results. It should be noted that the case of R=2.8 mm satisfies the condition of R>2.0 mm and hence corresponds to a conventional setup, while the cases of R=2.0 mm and R=1.5 mm satisfy R≤2.0 mm and hence meet the condition defined in the present invention.

(2) Pseudo Potential

Figure 8:
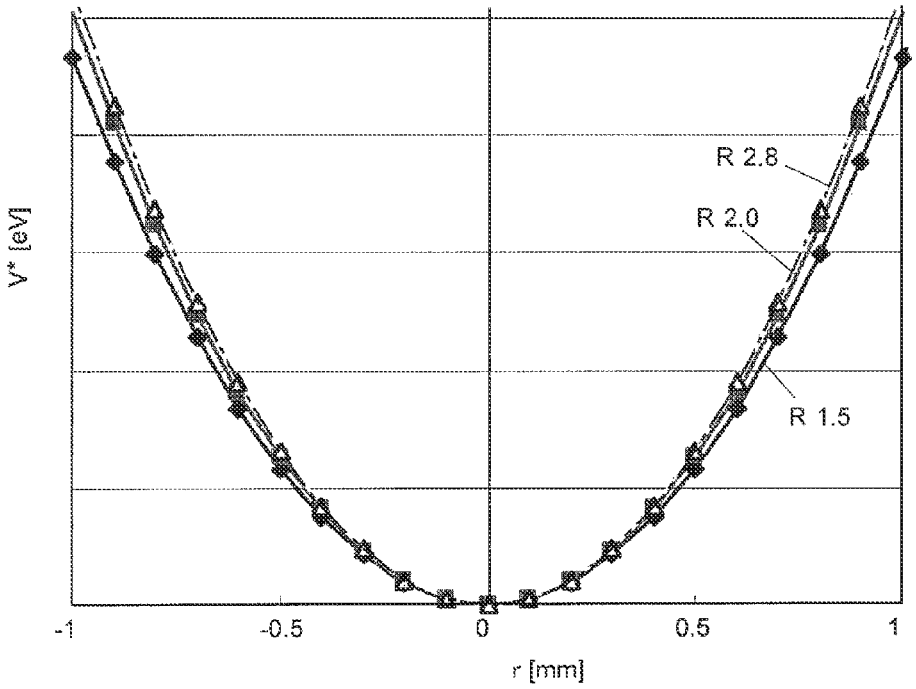
FIG. 8 shows a calculated result of a pseudo potential at a mass-to-charge ratio of m/z=168.

From the results shown in FIGS. 7A-7C, appropriate radio-frequency operating voltages for R=2.8 mm, R=2.0 mm and R=1.5 mm were respectively determined as 100 V, 50 V and 27 V. For each of these radio-frequency operating voltages, a pseudo potential (which represents the ion-focusing power) of the ion guides 12 and 14 was calculated using the following equation (1):

$$V^*(r)=(4qV^2/m\Omega^2 r_0^4)r^2 \quad (1),$$

where V is the value of the radio-frequency operating voltage, $r_0$ is the incircle radius of the ion guide, and r is the distance from the center of the ion guide ($0 \le r \le r_0$). FIG. 8 shows the calculated result of the pseudo potential at a mass-to-charge ratio of m/z=168. From the result shown in FIG. 8, it is possible to determine that any of the ion guides whose incircle radii are approximately within a range from 1.5 to 2.8 mm have almost identical pseudo potential shape, which means that the intrinsic ion-focusing effects of these ion guides are equal.

(3) Ion Intensity

Figure 9:
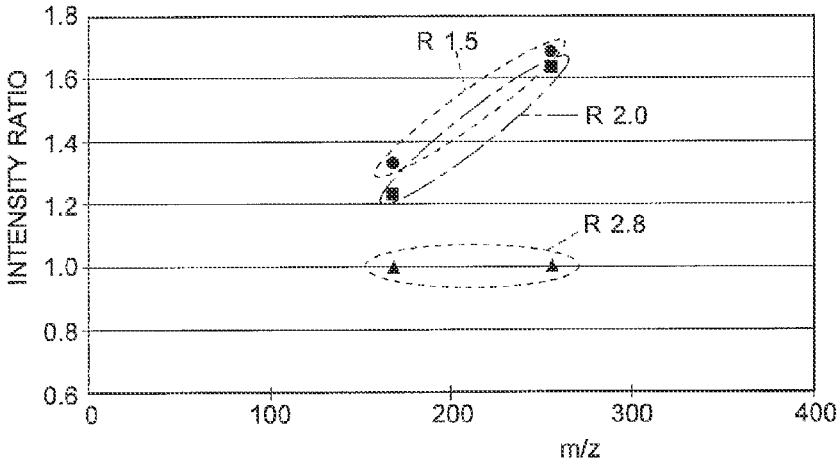
FIG. 9 shows measured values (relative values) of an ion intensity in the case of using ion guides having different radii of the incircle.

FIG. 9 shows relative values of the ion intensity for the three cases of R=2.8 mm, R=2.0 mm and R=1.5 mm, with the measured results for R=2.8 mm expressed as a relative value of 1. FIG. 9 demonstrates that the ion intensities for R=2.0 mm and R=1.5 mm were higher than the intensities for R=2.8 mm. As explained earlier, the ion-focusing effects of the ion guides at a mass-to-charge ratio of m/z=168 can be considered as equal. Accordingly, it can be said that the difference in the ion intensity shown in FIG. 9 dominantly depends on the relationship between the radius of the opening 13*a* of the ion lens 13 and the incircle radius of the ion guides 12 and 14. Thus, it is possible to conclude that the ion intensity improves when the incircle radius of the ion guides 12 and 14 is equal to or smaller than the radius of the opening of the ion lens 13.

A simulation computation has been conducted to investigate how a change in the relationship between the radius of the opening 13*a* of the ion lens 13 and the incircle radius of the ion guides 12 and 14 influences the radio-frequency electric field near the opening 13*a* of the ion lens 13. In the simulation, the incircle radii of the second and third ion guides 12 and 14 were fixed at 2.0 mm, while the diameter of the opening 13*a* of the ion lens 13 located between them was set at the three values of 3 mm, 4 mm and 5 mm. For each of these values, the potential distribution (equipotential lines) due to the quadrupole radio-frequency electric field on the plane A of the opening of the ion lens 13 orthogonal to the ion-beam axis C was calculated. The influence of the distance B between the ion lens 13 and the third ion guide 14 along the ion-beam axis C was also investigated by performing the calculation for each of the two cases of B=0.5 mm and B=1.5 mm. In these cases, the ion-focusing powers of the ion guides 12 and 14 can be regarded as equal since the radio-frequency voltages applied to those ion guides are the same.

Figure 10:
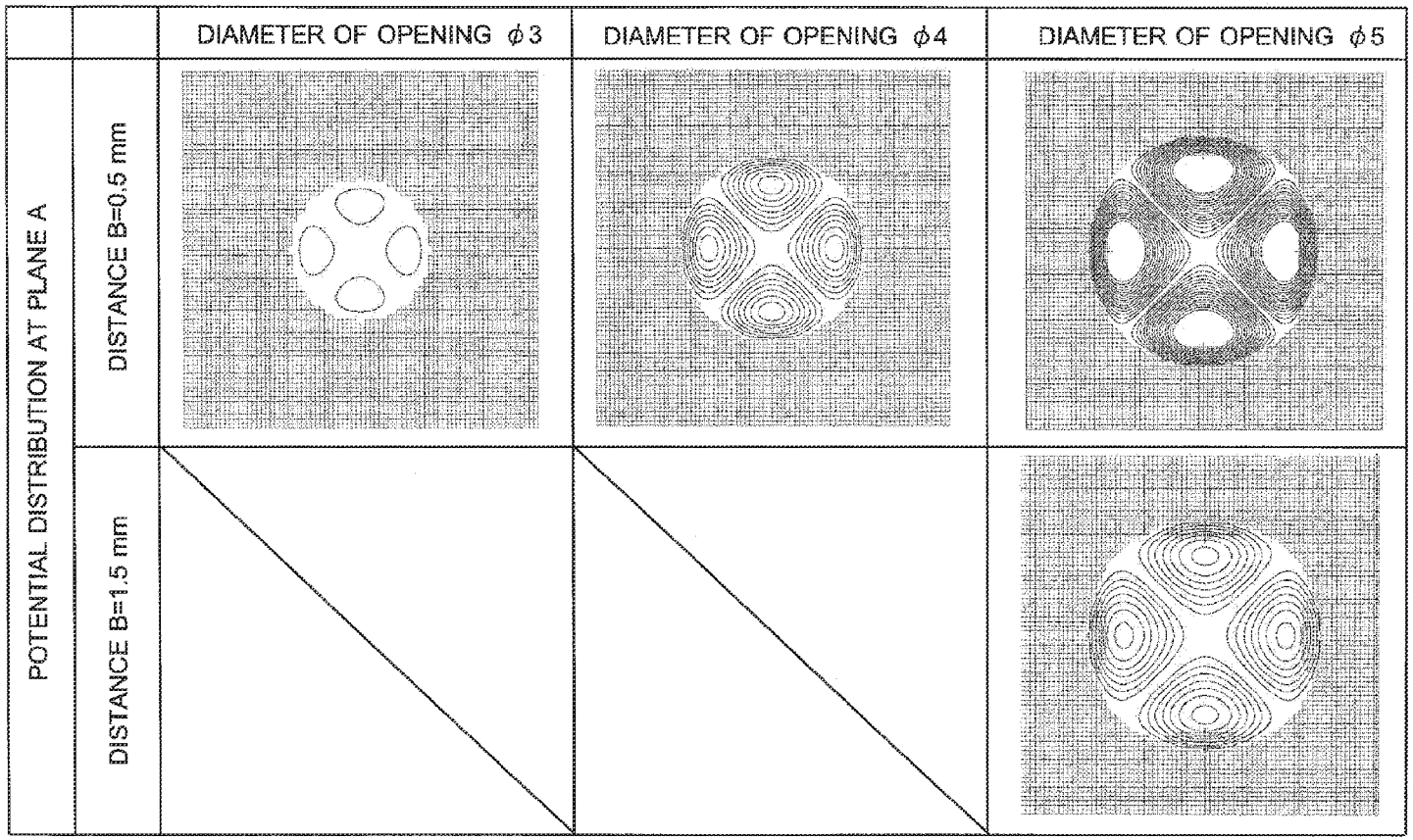
FIG. 10 shows calculated results of a potential distribution on the plane of an opening orthogonal to the ion-beam axis for different diameters of the opening of an ion lens.

FIG. 10 shows the calculated potential distributions. The result demonstrates that the potential distribution due to the quadrupole radio-frequency electric field significantly changes depending on the diameter of the opening 13*a* of the ion lens 13. Thus, it has been confirmed that, even if the intrinsic focusing power of the ion guide is the same, it is possible to make the radio-frequency electric field adequately penetrate into the opening 13*a* of the ion lens 13 by increasing the diameter of the opening 13*a* of the ion lens 13.

From the previously described results, it is possible to deduce that the improvement in the ion detection sensitivity which occurs when the radius of the opening 13*a* of the ion lens 13 is equal to or larger than the incircle radius of the ion guides 12 and 14, as shown in FIG. 9, is due to an increase in the ion-focusing power in the opening 13*a* of the ion lens 13 caused by the mutual penetration of the radio-frequency electric fields through the opening. The calculated result also demonstrates that, when the distance of the ion guide 12 or 14 from the ion lens 13 is increased, the degree of penetration of the radio-frequency electric fields naturally decreases, but the ion-focusing power can be sufficiently maintained by providing the ion lens 13 with a large opening 13*a*.

[Variations]

The configuration of the ion transport optical system in the mass spectrometer of the first embodiment can be changed in various forms. FIGS. 2-6 show examples of such specific variations.

Figure 3:
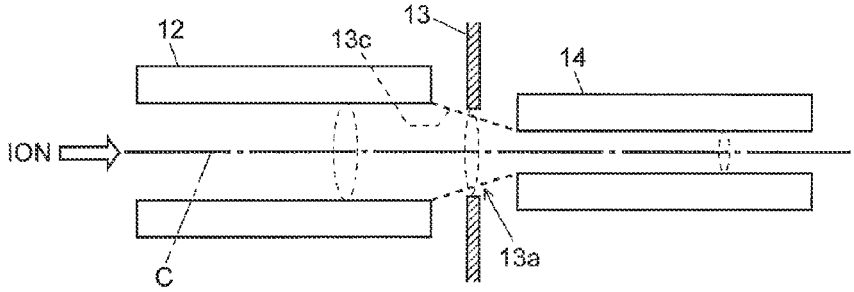
FIG. 3 is a configuration diagram of an ion transport optical system in the second embodiment.

The second embodiment shown in FIG. 3 is an example in which the incircle diameter of the third ion guide 14 is smaller than that of the second ion guide 12. In this case, the virtual tubular body 13*c* which straightly connects the incircle at the rear edge of the second ion guide 12 and the incircle at the front edge of the third ion guide 14 has a head-cut conical shape. Even in this case, the radio-frequency electric fields can be smoothly connected if the circumferential edge of the opening 13*a* of the ion lens 13 is located on or outside the circumferential surface of the tubular body 13*c*. This also holds true in the case where, as opposed to the example of FIG. 3, the incircle diameter of the second ion guide 12 is smaller than that of the third ion guide 14.

Figure 4:
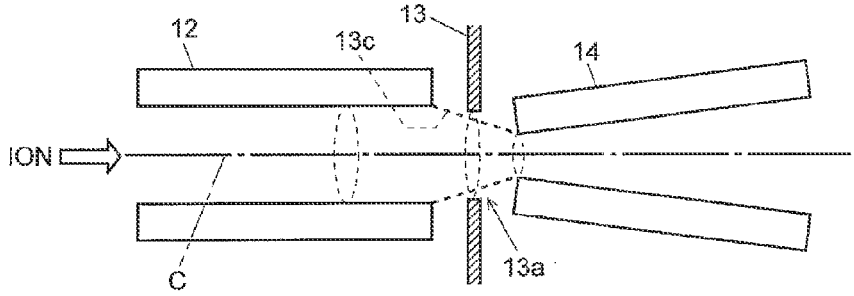
FIG. 4 is a configuration diagram of an ion transport optical system in the third embodiment.

The third embodiment shown in FIG. 4 differs from the configuration of the second embodiment in that the rod electrodes of the third ion guide 14 are not aligned parallel to the ion-beam axis C and are arranged so that its incircle radius gradually increases in the travelling direction of the ions. As in the second embodiment, the virtual tubular body 13*c* which straightly connects the incircle at the rear edge of the second ion guide 12 and the incircle at the front edge of the third ion guide 14 has a head-cut conical shape, and the minimal requirement is that the circumferential edge of its opening 13*a* of the ion lens 13 should be located on or outside the circumferential surface of the tubular body 13*c*. This also holds true in the case where, as opposed to the example of FIG. 4, the incircle diameter of the second ion guide 12 gradually increases in the opposite direction to the travelling direction of the ions.

Figure 5:
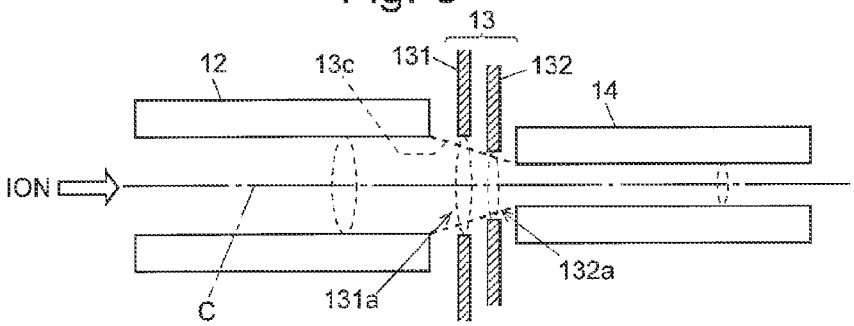
FIG. 5 is a configuration diagram of an ion transport optical system in the fourth embodiment.

In any of the configurations shown in FIGS. 2-4, the ion lens 13 consists of a single plate member. The fourth embodiment shown in FIG. 5 is an example in which the ion lens 13 is composed of a plurality of plate members arranged along the ion-beam axis C. Once again, the minimal requirement is that the circumferential edges of the openings of all the members constituting the ion lens 13 are located on or outside the circumferential surface of the tubular body 13*c*.

Figure 6:
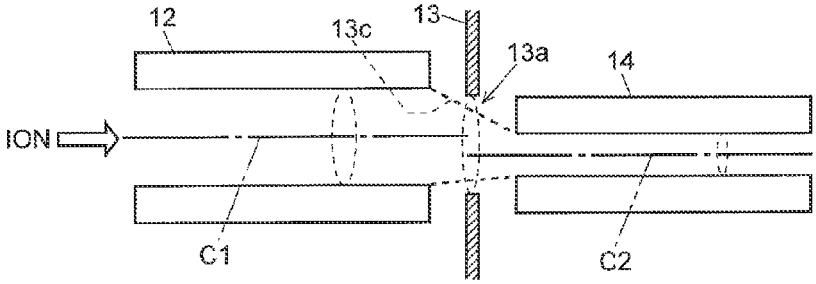
FIG. 6 is a configuration diagram of an ion transport optical system in the fifth embodiment.

In any of the configurations shown in FIGS. 2-5, the two ion guides 12 and 14 as well as the ion lens 13 have their ion-beam axes lying on the same straight line. However, the present invention is also applicable in a so-called "off-axis" optical system, i.e. a system in which the ion-beam axis of the second ion guide 12 and that of the third ion guide 14 are not on the same straight line. FIG. 6 shows a configuration example in which the ion-beam axis C1 of the second ion guide 12 and the ion-beam axis C2 of the third ion guide 14 are parallel to each other and do not lie on the same straight line. Once again, as in the previous examples, the effective continuity of the radio-frequency electric fields can be ensured if the circumferential edge of its opening 13*a* of the ion lens 13 is located on or outside the circumferential surface of the virtual tubular body 13*c* which straightly connects the incircle at the rear edge of the second ion guide 12 and the incircle at the front edge of the third ion guide 14.

It should be noted that the previous embodiments are mere examples, and any change, modification or addition appropriately made within the spirit of the present invention will evidently fall within the scope of claims of the present patent application.

For example, although the ion guides in the previous embodiments were quadrupole type, it is possible to use a different type of multi-pole configuration, such as an octapole type. The number of poles of the front-stage ion guide and that of the rear-stage ion guide do not need to be the same. Furthermore, although the third ion guide in the previous embodiments is an ion optical device for simply transporting ions by means of a radio-frequency electric field, the third ion guide itself may be configured as a quadrupole mass filter for separating ions according to their mass-to-charge ratios or as a pre-filter which is placed before the main quadrupole mass filter.

REFERENCE SIGNS LIST

1 . . . Ionization Chamber
2 . . . First Intermediate Vacuum Chamber
3 . . . Second Intermediate Vacuum Chamber

4 . . . Third Intermediate Vacuum Chamber
5 . . . Analyzing Chamber
6 . . . Ionization Probe
7 . . . Nozzle
9 . . . Desolvation Pipe
10 . . . First Ion Guide
11 . . . Skimmer
12 . . . Second Ion Guide
13 . . . Ion lens
13*a* . . . Opening
13*b* . . . Circumferential Edge of Opening
13*c* . . . Tubular Body
14 . . . Third Ion Guide
15 . . . Quadrupole Mass Filter
16 . . . Ion Detector
20 . . . Controller
21 . . . First AC-DC Voltage Source
22 . . . First DC Voltage Source
23 . . . Second AC-DC Voltage Source
24 . . . Second DC Voltage Source
25 . . . Third AC-DC Voltage Source
C, C1, C2 . . . Ion-Beam Axis

The invention claimed is:

1. A mass spectrometer having an ion transport optical system in which an ion lens or an aperture plate having an opening for allowing ions to pass through is provided between a front-stage multi-pole ion guide and a rear-stage multi-pole ion guide, wherein:

a voltage source for applying a radio-frequency voltage to each of the front-stage and rear-stage ion guides, the two radio-frequency voltages having a same frequency and a same phase, or a same frequency with a phase difference within a predetermined allowable range; and a relationship between a size of the opening of the ion lens or the aperture plate and a radius of an incircle of each of the ion guides is determined so that a circumferential edge of the opening of the ion lens or the aperture plate is located on or outside a circumferential surface of a virtual tubular body straightly connecting the incircle at a rear edge of the front-stage ion guide and the incircle at a front edge of the rear-stage ion guide.

2. The mass spectrometer according to claim 1, wherein the front-stage and rear-stage ion guides have their respective straight ion-beam axes lying on a same straight line, each of the ion guides being composed of a plurality of rod electrodes aligned parallel to the ion-beam axis, and the two ion guides having the same incircle radius.

3. The mass spectrometer according to claim 2, wherein an ion-beam axis of the ion lens or the aperture plate lies on the same straight line as the ion-beam axes of the front-stage and rear-stage ion guides, and a radius of the circular opening of the ion lens or the aperture plate is equal to the incircle radius of the two ion guides.

4. The mass spectrometer according to claim 1, wherein the front-stage and rear-stage ion guides have their respective straight ion-beam axes lying on a same straight line, each of the ion guides being composed of a plurality of rod electrodes aligned parallel to the ion-beam axis, and the incircle radius of one of the ion guides being smaller than the incircle radius of the other ion guide.

5. The mass spectrometer according to claim 1, wherein the front-stage and rear-stage ion guides have their respective straight ion-beam axes lying on the same straight line, each of the ion guides being composed of a plurality of rod electrodes arranged along the ion-beam axis, and the rod electrodes of at least one of the ion guides being arranged so that the incircle radius increases with an increase in a distance from the ion lens or the aperture plate.

6. The mass spectrometer according to claim 4, wherein:

the ion-beam axis of the ion lens or the aperture plate lies on the same straight line as the ion-beam axes of the two ion guides;

the incircle radius at the rear edge of the front-stage ion guide is different from the incircle radius at the front edge of the rear-stage ion guide; and a radius of a circular opening of the ion lens or the aperture plate is larger than the radius of either the incircle at the rear edge of the front-stage ion guide or the incircle at the front edge of the rear-stage ion guide, whichever is smaller, as well as smaller than the radius of the other incircle.

7. The mass spectrometer according to claim 1, wherein each of the front-stage and rear-stage ion guides is composed of a plurality of rod electrodes arranged along a straight ion-beam axis, and the ion-beam axes of the two ion guides are parallel to each other and do not lie on a same straight line.

8. The mass spectrometer according to claim 1, wherein a distance between the rear edge of the front-stage ion guide and the ion lens or the aperture plate, as well as a distance between the front edge of the rear-stage ion guide and the ion lens or the aperture plate, are determined so as to allow a radio-frequency electric field created by each of the ion guides to penetrate into the opening of the ion lens or the aperture plate.

9. The mass spectrometer according to claim 8, wherein each of the distances is equal to or smaller than both the incircle radius of the ion guide and the radius of the opening.

10. The mass spectrometer according to claim 1, wherein the ion lens or the aperture plate doubles as, or be provided in, a partition wall separating two spaces maintained at different degrees of vacuum.

11. The mass spectrometer according to claim 1, wherein the rear-stage ion guide functions as a quadrupole mass filter for separating ions according to their mass-to-charge ratios or as a pre-filter provided before a main quadrupole mass filter.

12. The mass spectrometer according to claim 5, wherein:

the ion-beam axis of the ion lens or the aperture plate lies on the same straight line as the ion-beam axes of the two ion guides;

the incircle radius at the rear edge of the front-stage ion guide is different from the incircle radius at the front edge of the rear-stage ion guide; and a radius of a circular opening of the ion lens or the aperture plate is larger than the radius of either the incircle at the rear edge of the front-stage ion guide or the incircle at the front edge of the rear-stage ion guide, whichever is smaller, as well as smaller than the radius of the other incircle.

* * * * *